US009796016B2

(12) United States Patent
Kurosawa et al.

(10) Patent No.: US 9,796,016 B2
(45) Date of Patent: Oct. 24, 2017

(54) METHOD FOR CONTINUOUSLY CASTING SLAB CONTAINING TITANIUM OR TITANIUM ALLOY

(71) Applicant: Kobe Steel, Ltd., Hyogo (JP)

(72) Inventors: Eisuke Kurosawa, Kobe (JP); Kazuyuki Yanagiya, Kobe (JP); Takehiro Nakaoka, Kobe (JP); Hidetaka Kanahashi, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 15/375,595

(22) Filed: Dec. 12, 2016

(65) Prior Publication Data

US 2017/0197243 A1 Jul. 13, 2017

(30) Foreign Application Priority Data

Jan. 7, 2016 (JP) ..... 2016-001975

(51) Int. Cl.

| | |
|---|---|
| ***B22D 11/10*** | (2006.01) |
| ***B22D 11/11*** | (2006.01) |
| ***B22D 41/015*** | (2006.01) |
| ***B22D 11/00*** | (2006.01) |
| ***B22D 11/041*** | (2006.01) |
| ***B22D 21/00*** | (2006.01) |

(52) U.S. Cl.

CPC ..... *B22D 11/001* (2013.01); *B22D 11/041* (2013.01); *B22D 11/10* (2013.01); *B22D 21/005* (2013.01); *B22D 41/015* (2013.01)

(58) Field of Classification Search

CPC ..... B22D 11/001; B22D 11/10; B22D 11/11; B22D 21/005; B22D 41/015

USPC ..... 164/469, 508

See application file for complete search history.

(56) References Cited

U.S. PATENT DOCUMENTS

| | | | | |
|---|---|---|---|---|
| 3,342,250 | A * | 9/1967 | Treppschuh | B22D 11/00 164/258 |
| 3,764,297 | A * | 10/1973 | Coad | C22B 9/20 164/469 |
| 6,561,259 | B2 * | 5/2003 | Spadafora | B22D 11/001 164/437 |
| 6,868,896 | B2 * | 3/2005 | Jackson | B22D 11/001 164/514 |

(Continued)

FOREIGN PATENT DOCUMENTS

| | | |
|---|---|---|
| JP | 2013-107130 A | 6/2013 |
| JP | 2014-233753 A | 12/2014 |

*Primary Examiner* — Kevin E Yoon

(74) *Attorney, Agent, or Firm* — Studebaker & Brackett PC

(57) ABSTRACT

The present invention provides a method for casting a slab with good cast surface quality. The method includes pouring molten metal 8 into a mold 2 from one of the paired shorter sides of the mold 2 while allowing superheat ΔT [° C.], which is a temperature difference obtained by subtracting the melting point Tm [° C.] of the raw material from the temperature Tin [° C.] of the molten material on the surface of the molten metal in the mold and at the pouring point of the molten metal, to satisfy the following Formula (1) and Formula (2):

$$0.0014\Delta T^{2\ +0.0144\Delta}T+699.45>800 \quad \text{Formula (1)}$$

$$0.0008\Delta T^{2\ +0.2472\Delta}T+853.02<1250 \quad \text{Formula (2)}$$

4 Claims, 14 Drawing Sheets

(56) References Cited

U.S. PATENT DOCUMENTS

| | | | | |
|---|---|---|---|---|
| 2011/0308291 | A1* | 12/2011 | Tanaka | B22D 11/001 72/199 |
| 2014/0360694 | A1* | 12/2014 | Nakaoka | B22D 11/001 164/469 |

* cited by examiner

METHOD FOR CONTINUOUSLY CASTING SLAB CONTAINING TITANIUM OR TITANIUM ALLOY

BACKGROUND OF THE INVENTION

Field of the Invention

The present invention relates to a method for continuously casting a slab containing titanium or a titanium alloy Description of the Related Art Conventionally, an ingot has been continuously cast by melting metal by vacuum arc or electron beam, and pouring the metal into an open mold where the metal is solidified and withdrawn from the bottom of the mold.

An ingot containing titanium or a titanium alloy is continuously cast while the surface of the molten metal in the mold is heated by plasma arc or electron beam.

If an excessively high heat input is applied to the surface of the molten metal in the mold, a solidified shell is not sufficiently grown and becomes excessively thin. Thus, when the solidified metal is withdrawn, the surface of the solidified shell is torn due to lack of strength, which leads to an accident such as bleed-out. In contrast, if an excessively low heat input is applied to the surface of the molten metal in the mold, a solidified shell is overgrown, resulting in spread of the molten metal. This leads to a large surface defect and makes it impossible to assure a sufficient molten metal pool, which precludes continuous casting. Thus, the amount of heat input should be in a proper range for good cast surface quality.

When a slab having a rectangular cross-section is continuously cast, there is a limit to the size of a chamber for accommodating a casting machine, and the molten metal is typically poured from a hearth into a mold through one of the paired shorter sides of the rectangular mold. However, the flow and the temperature of the molten metal create a difference in the temperature of a region near the surface of the molten metal between the metal inlet side and the side opposite the metal inlet side, and heat input is applied circumferentially non-uniformly. As a result, the solidification varies with circumferential position in a slab, which degrades the cast surface quality of the resulting slab.

A slab with poor cast surface quality requires removal of surface flaws before rolling, causing problems such as decreased yield and increased operations, which are responsible for increased cost. Thus, there exists a need for casting a slab with its cast surface having minimum irregularities and flaws.

JP 2013-107130 A discloses a method for casting a titanium slab to be hot rolled, the method including pouring molten metal simultaneously from the both walls on the paired shorter sides of a mold. Pouring of molten metal simultaneously from the both walls on the paired shorter sides ensures uniform temperature of the molten metal in the mold along the length of the mold walls on the opposing longer sides, which suppresses deformation (warpage) in the thin thickness direction. The temperature is also uniform along the length of the mold walls on the shorter sides, which can further inhibit deformation (bending) in the width direction.

JP 2014-233753 A discloses a method for melting and re-solidifying the surface of an ingot prepared by casting an ingot and cold-working the surface layer of the ingot or only by melting metal and casting an ingot. Melting and re-solidification of only the surface layer of an ingot allows provision of a pure titanium ingot for industrial use with decreased surface flaws and good surface quality.

Problems to Be Solved By the Invention

However, in the method in JP 2013-107130 A, it is necessary to provide a hearth on each of the paired shorter sides of the mold, which increases the size of the chamber. The increased number of hearths also increases the number of heat sources for heating molten metal in the hearths, which increases production costs. In the method in JP 2014-233753 A, a re-melting process is added, which increases production costs. From the standpoint of suppressing the production cost, it is preferred to pour molten metal from one of the paired shorter sides of a mold. It is also preferred to allow rolling of a cast slab with no additional process.

The inventors thought that when molten metal is poured from one of the paired shorter sides of a rectangular mold, a surface region of molten metal on the metal inlet side, the region not only being heated by heat sources but also receiving the molten metal, would have a higher temperature than a surface region on the side opposite the metal inlet side, the region being only heated by the heat sources. However, study of the cast surface quality of a cast slab has revealed that a surface region on the metal inlet side exhibited poorer cast surface quality than a surface region on the side opposite the metal inlet side. The inventors have found that this is due to the fact that a surface region on the metal inlet side has a temperature lower than the temperature of a surface region on the side opposite the metal inlet side.

The surface of the molten metal in the mold has a temperature of 2000° C. or higher at the position heated by heat sources. The surface of the molten metal on the side opposite the metal inlet side has an average temperature from 1900° C. to 2000° C. In contrast, molten metal poured through a pouring lip of the hearth into the surface of the molten metal in the mold is presumed to have a temperature near the melting point of molten titanium or a molten titanium alloy (in the case of pure titanium, the melting point is about 1680° C.), because a thick solidified layer is formed around the pouring lip. The surface of the molten metal in the hearth has an average temperature from 1900° C. to 2000° C. However, the pouring lip of the hearth has a narrow width and high cooling ability. Thus, the temperature of the metal is decreased to around the melting point when passing through the pouring lip.

Then, the surface on the metal inlet side receives the molten metal having a temperature lower than the average temperature of the surface of the molten metal on the side opposite the metal inlet side, and thus the surface on the metal inlet side has an insufficient heat input. As a result, a solidified shell grows more quickly on the surface of the molten metal along the longer sides of the mold especially on the metal inlet side, whereby the cast surface quality degrades. It is an object of this invention to provide a method for continuously casting a slab containing titanium or a titanium alloy and having a good cast surface.

Means of Solving the Problems

The present invention provides a method for continuously casting a slab containing titanium or a titanium alloy, the method including melting a raw material containing titanium or a titanium alloy to form molten metal, and pouring the molten metal into an open mold having a rectangular cross-section where the molten metal is solidified and withdrawn from the bottom of the mold. The molten metal is poured into the mold from one of the paired shorter sides of the mold while allowing superheat $\Delta T$ [° C.] which is a temperature difference obtained by subtracting the melting point Tm [° C.] of the raw material from the temperature Tin [° C.] of the raw material on the surface of the molten metal in the mold and at the pouring point of the molten metal, to satisfy the following Formula (1) and Formula (2):

$$0.0014\Delta T^2+0.0144\Delta T+699.45>800 \quad \text{Formula (1)}$$

$$0.0008\Delta T^2+0.2472\Delta T+853.02<1250 \quad \text{Formula (2)}$$

Effects of the Invention

According to the present invention, the molten metal is poured from one of the paired shorter sides of the mold while allowing superheat ΔT [° C.], which is a temperature difference obtained by subtracting the melting point Tm [° C.] of the raw material from the temperature Tin [° C.] of the molten material on the surface of the molten metal in the mold and at the pouring point of the molten metal, to satisfy the following Formula (1) and Formula (2). To resolve insufficient heat input of the surface of the molten metal on the metal inlet side, the surface of the molten metal in the mold at the pouring point of the molten metal needs to have a temperature that is at least equal to or higher than the average temperature of the surface of the molten metal on the side opposite the metal inlet side. Satisfaction of the above Formula (1) and Formula (2) by the superheat ΔT allows an increase of the temperature of the surface of the molten metal in the mold at the pouring point of the molten metal. This reduces the difference in the temperature/the amount of heat input between the metal inlet side and the side opposite the metal inlet side, and thus the slab can have good cast surface quality over the entire longer sides. This allows casting of a slab with a good cast surface.

DESCRIPTION OF THE EMBODIMENTS

Now, a preferred embodiment of the present invention will be described with reference to the drawings.

(Configuration of Continuous Casting Machine)

A method for continuously casting a slab containing titanium or a titanium alloy according to the embodiment includes melting a raw material containing titanium or a titanium alloy to form molten metal, and pouring the molten metal into an open mold having a rectangular cross-section where the molten metal is solidified and withdrawn from the bottom of the mold.

Figure 1:
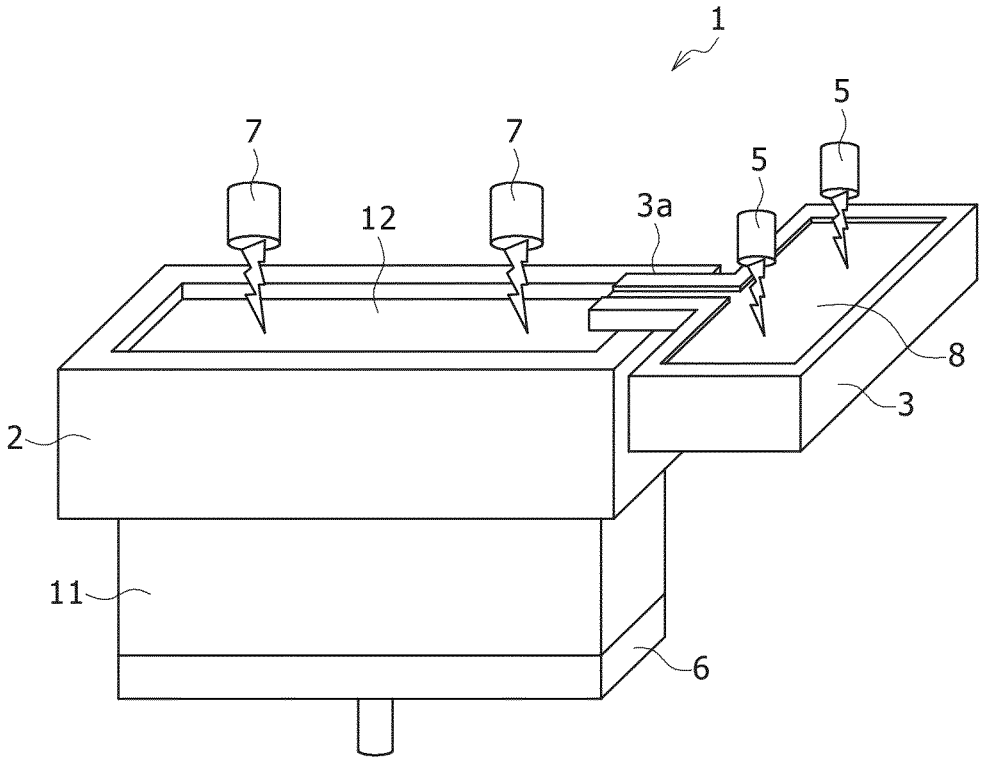
FIG. 1 is a perspective view of a continuous casting machine.
Figure 2:
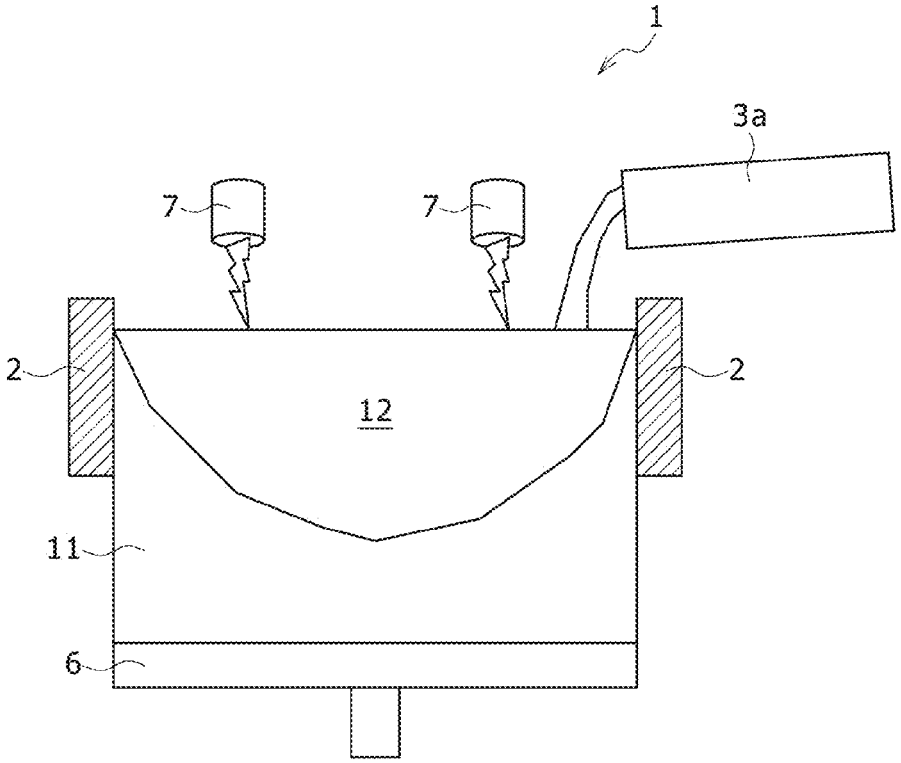
FIG. 2 is a cross-sectional view of the continuous casting machine.

As illustrated in FIG. 1, which is a perspective view, and FIG. 2, which is a cross-sectional view, a continuous casting machine 1 for carrying out the method includes an open mold 2 having a rectangular cross-section. The mold 2 is made of copper and is configured to be cooled by water circulating inside at least inner parts of the walls defining the rectangular opening. The lower opening of the mold 2 can be occupied by a starting block 6, which is raised and lowered by a drive mechanism (not shown).

The continuous casting machine 1 includes a cold hearth 3 from which molten metal 8 is poured into the mold 2. A material feeder (not shown) feeds a raw material (material to be melted) such as sponge titanium or titanium scrap for titanium or a titanium alloy into the cold hearth 3. The material in the cold hearth 3 is melted by a plasma arc produces by plasma torches 5 disposed above the cold hearth 3. The cold hearth 3 pours the molten metal 8, which is formed by melting the raw material, at a predetermined flow rate through a pouring lip 3 a into the mold 2. In the embodiment, the cold hearth 3 is provided on one of the paired shorter sides of the mold 2 and pours the molten metal 8 from the one of the shorter sides of the mold 2. In FIG. 2, the illustration of the cold hearth 3 is omitted.

The continuous casting machine 1 also includes plasma torches 7 disposed above the mold 2. The plasma torches 7 heat the surface of the molten metal 12 in the mold 2 with a plasma arc, while the plasma torches 7 are horizontally moved over the surface of the molten metal 12 by a moving means (not shown). Movement of the plasma torches 7 is controlled by a controller (not shown).

The continuous casting machine 1 is housed in a chamber (not shown) that is filled with inert gas. Thus, the continuous casting machine 1 is surrounded by inert gas such as argon gas or helium gas.

In such configuration, the molten metal 12 in the mold 2 begins to solidify from a surface in contact with the water-cooled mold 2. Then, the starting block 6 that has occupied the lower opening of the mold 2 is lowered at a predetermined speed so that a rectangular prismatic slab 11, which has been formed through solidification of the molten metal 12 is continuously cast while being withdrawn downward.

In the case of electron beam melting in a vacuum, it would be difficult to cast a titanium alloy, because minor components would be evaporated. In contrast, plasma arc melting in an inert gas allows casting of a titanium alloy as well as pure titanium.

The continuous casting machine 1 may include a flux feeder for adding solid or liquid flux to the surface of the molten metal 12 in the mold 2. In the case of electron beam melting in a vacuum, it would be difficult to add the flux to the molten metal 12 in the mold 2, because the flux would be scattered. In contrast, plasma arc melting in an inert gas advantageously allows addition of the flux to the molten metal 12 in the mold 2.

(Cast Surface Defects)

If the surface (cast surface) of a continuously-cast slab 11 containing titanium or a titanium alloy has an irregularity or a flaw, a surface defect occurs in a subsequent rolling process. Thus, it is necessary to remove the irregularity or the flaw on the surface of the slab 11, for example, by cutting before rolling. This causes problems such as decreased yield and increased operations, which are responsible for increased cost. Thus, there exists a need for casting a slab 11 with its cast surface having minimum irregularities and flaws.

Figure 3:
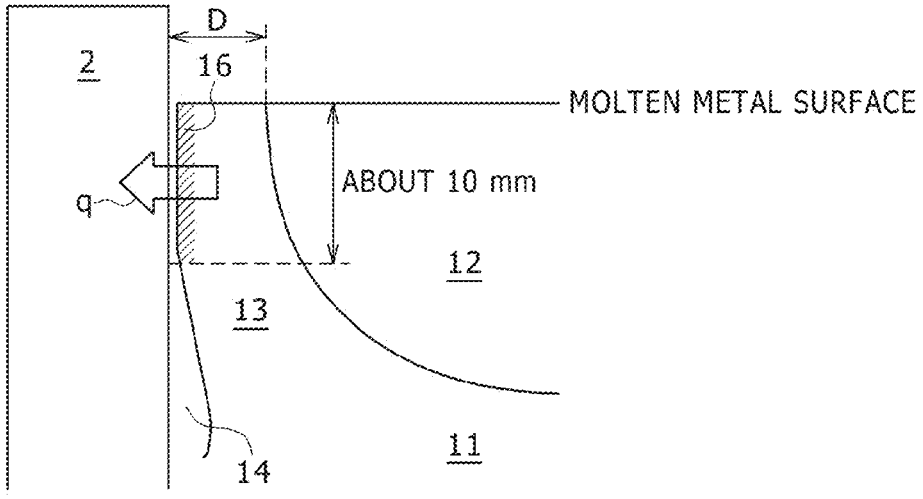
FIG. 3 is a model diagram illustrating a full contact region of a mold and a slab.

In continuous casting of a slab 11, the slab 11 (a solidified shell 13) is in contact with the mold 2 only in a region close to the surface of the molten metal 12 heated by plasma arc (a region extending about 10 mm down from the surface of the molten metal), as illustrated in FIG. 3, which is a model diagram. In a region deeper than the region, the slab 11 is heat-shrunk, which creates an air gap 14 between the mold 2 and the slab 11. The region extending about 10 mm down from the surface of the molten metal is hereinafter referred to as full contact region 16 (the region represented by hatched lines in FIG. 3). In the full contact region 16, a passing heat flux q is produced from the slab 11 to the mold 2. The symbol "D" in FIG. 3 represents the thickness of the solidified shell 13.

Figure 4A:
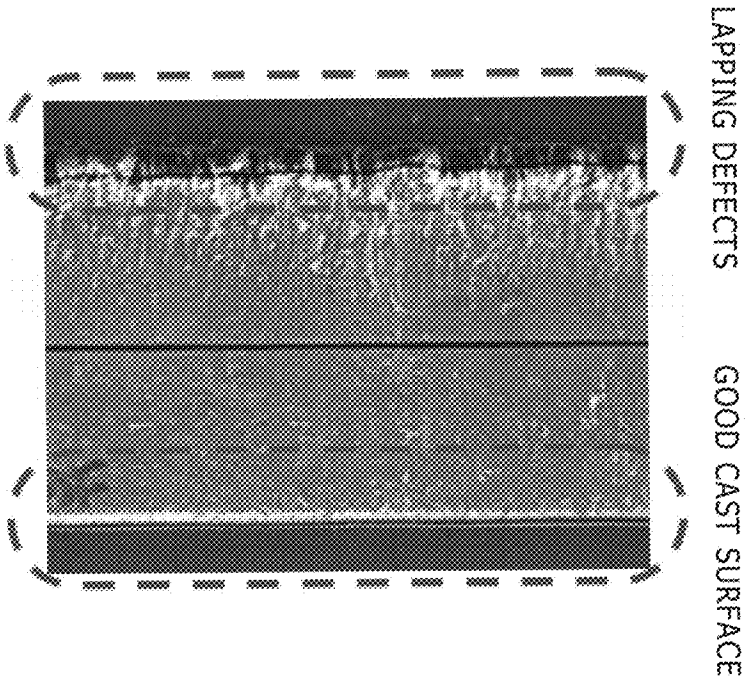
FIG. 4A is a surface photograph of the slab.
Figure 4B:
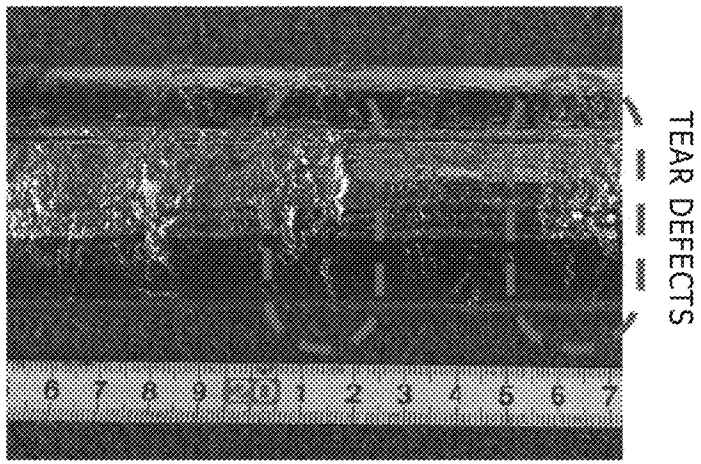
FIG. 4B is a surface photograph of the slab.

If an excessively high heat input is applied to the surface of the molten metal 12, the solidified shell 13 does not grow sufficiently and becomes excessively thin, and the surface of the solidified shell 13 is torn off due to lack of strength. This is called "tear defect". In contrast, if an excessively low heat input is applied to the surface of the molten metal 12, the molten metal 12 is lapped over the overgrown (thickened) solidified shell 13, which causes a serious surface defect. This is called a "lapping defect". FIG. 4A is a surface photograph of a slab 11 with a "lapping defect", while FIG. 4B is a surface photograph of a slab 11 with a "tear defect".

(Surface Temperature of Ingot Achieving Acceptable Amount of Irregularities in Cast Surface)

Figure 5:
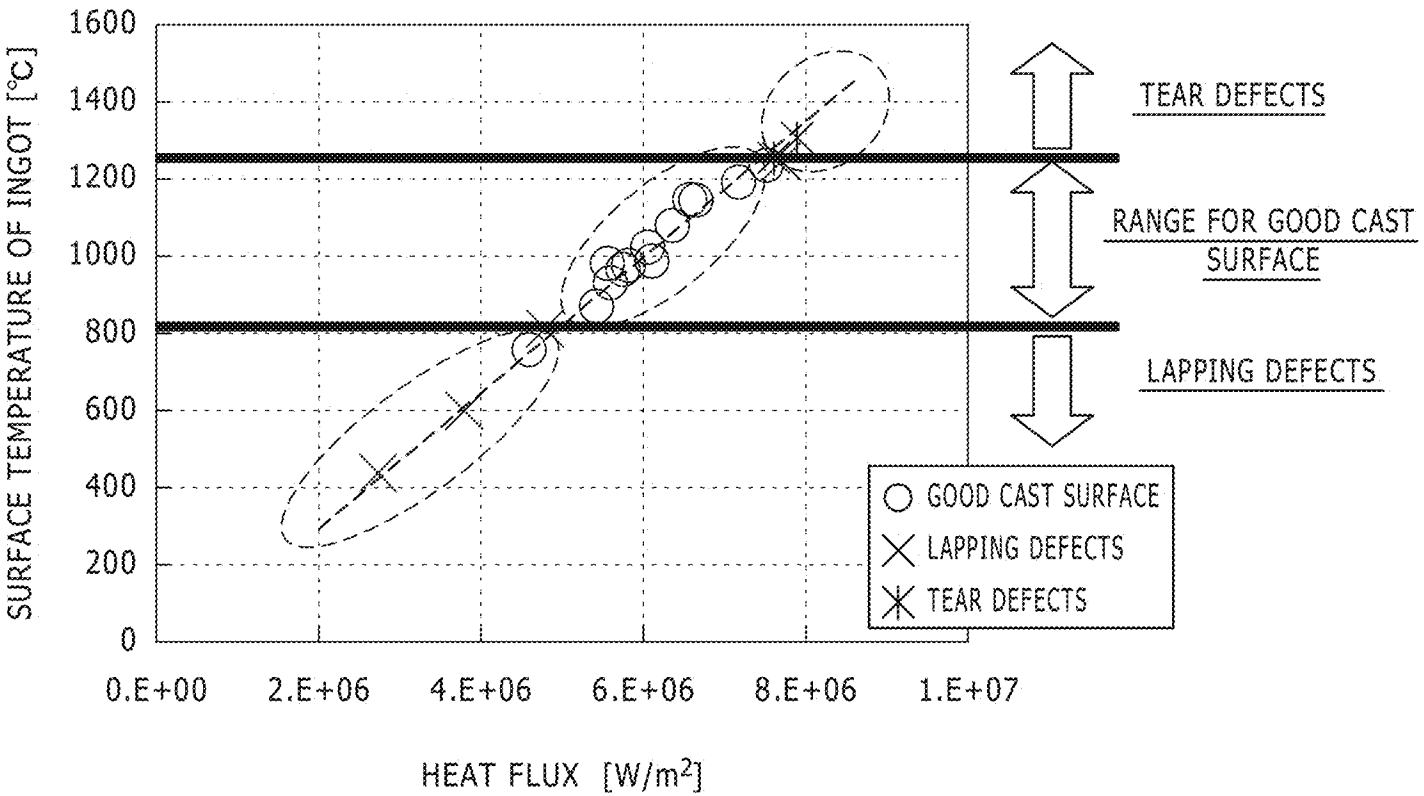
FIG. 5 is a graph illustrating the relationship between passing heat flux and surface temperature of an ingot.

FIG. 5 illustrates the relationship between the passing heat flux q and the surface temperature Ts (surface temperature of an ingot) of a slab 11. The passing heat flux q [W/m$^2$], which is an indicator of heat balance, and the surface temperature Ts [° C.] of a slab 11 are evaluated in terms of an average in the full contact region 16. The relationship diagram shows that if the slab 11 has a range of an average surface temperature Ts from 800° C. to 1250° C. exclusive in the full contact region 16 of the mold 2 and the slab 11, the slab 11 can have a good cast surface without tear defects or lapping defects.

(Superheat)

The inventors thought that when the molten metal is poured from one of the paired shorter sides of the rectangular mold 2 as illustrated in FIG. 1, a surface region on the metal inlet side, the region being not only heated by the heat sources, but also receiving the molten metal 8, would have a higher temperature than a surface region on the side opposite the metal inlet side, the region being only heated by the heat sources. As used herein, the metal inlet side refers to the half of the mold 2 that is divided vertically and that is closer to the cold hearth 3 (the right half of the mold 2 in FIG. 1), while the side opposite the metal inlet side refers to the opposite half (the left half of the mold 2 in FIG. 1).

However, study of the cast surface quality of a cast slab 11 has revealed that the surface on the metal inlet side exhibited poorer quality than the surface on the side opposite the metal inlet side. The inventors have found that this is due to the fact that the surface on the metal inlet side has a temperature lower than the temperature of the surface on the side opposite the metal inlet side.

The surface of the molten metal 12 in the mold 2 has a temperature of 2000° C. or higher at the points heated by the heat sources. The surface on the side opposite the metal inlet side has an average temperature from 1900° C. to 2000° C. In contrast, the molten metal 8 poured through the pouring lip 3*a* of the cold hearth 3 into the surface of the molten metal 12 in the mold 2 is presumed to have a temperature near the melting point of the molten titanium or titanium alloy (in the case of pure titanium, the melting point is about 1680° C.), because a thick solidified layer is formed around the pouring lip 3*a*. The surface of the molten metal 8 in the cold hearth 3 has an average temperature from 1900° C. to 2000° C. However, the pouring lip 3*a* of the cold hearth 3 has a narrow width and high cooling ability. Thus, when the molten metal 8 is passed through the pouring lip 3*a*, the temperature of the metal 8 is decreased to around the melting point.

Figure 6:
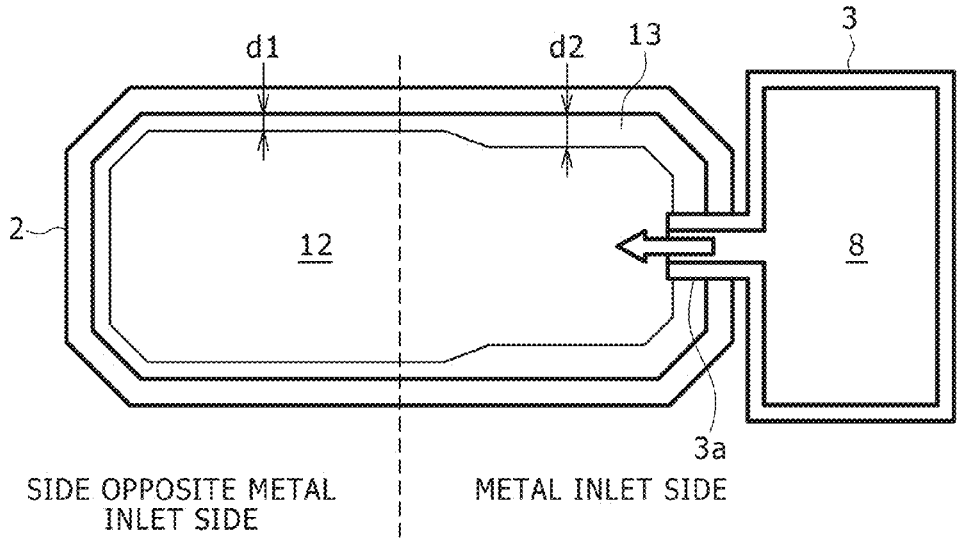
FIG. 6 is a top view of the continuous casting machine.

The molten metal 8 poured into the surface on the metal inlet side has a temperature lower than the average temperature of the surface of the molten metal on the side opposite the metal inlet side, and thus insufficient heat input is applied to the surface on metal inlet side. As a result, as illustrated in FIG. 6, which is a top view, the thickness d1 of the solidified shell 13 on the surface of the molten metal along each longer side of the mold 2 on the side opposite the metal inlet side (left side in FIG. 6) is smaller than the thickness d2 of the solidified shell 13 on the surface of the molten metal along the longer side of the mold 2 on the metal inlet side (right side in FIG. 6), i.e., d2>d1. In this manner, the solidified shell 13 grows more quickly on the surface of the molten metal along the longer sides of the mold 2 especially on the metal inlet side, whereby the cast surface quality degrades.

Thus, in the embodiment, the molten metal 8 is poured from one of the paired shorter sides of the mold 2 into the mold 2 under conditions that superheat ΔT [° C.] satisfies the following Formula (1) and Formula (2). As used herein, the superheat ΔT [° C.], which is a temperature difference obtained by subtracting the melting point Tm [° C.] of the raw material from the temperature Tin [° C.] of the molten material on the surface of the molten metal in the mold and at the pouring point of the molten metal.

$$0.0014\Delta T^2+0.0144\Delta T+699.45>800 \quad \text{Formula (1)}$$

$$0.0008\Delta T^2+0.2472\Delta T+853.02<1250 \quad \text{Formula (2)}$$

To resolve insufficient heat input of the surface of the molten metal on the metal inlet side, the surface of the molten metal 12 in the mold 2 at the pouring point of the molten metal 8 needs to have a temperature that is at least equal to or higher than the average temperature of the surface of the molten metal on the side opposite the metal inlet side. If the superheat ΔT satisfies the above Formula (1) and Formula (2), the surface of the molten metal 12 in the mold 2 at the pouring point of the molten metal 8 can have an increased temperature. This reduces the difference in the temperature/the amount of heat input between the metal inlet side and the side opposite the metal inlet side, and thus the slab 11 can have good cast surface quality over the entire longer side. This allows casting of a slab 11 with a good cast surface.

In the embodiment, the superheat ΔT is set at 300° C. or higher. This suitably allows the surface of the molten metal 12 in the mold 2 at the pouring point of the molten metal 8 to have an increased temperature. This can sufficiently reduce the difference in the temperature/the amount of heat input between the metal inlet side and the side opposite the metal inlet side.

Plasma arc melting, in which the surface of the molten metal 12 in the mold 2 is heated by plasma arc, allows the surface of the molten metal 12 in the mold 2 at the pouring point of the molten metal 8 to have an increased temperature, and thus the slab 11 can have good cast surface quality over the entire longer side.

The quantitative conditions of the temperature on the surface of the molten metal 12 in the mold 2 at the pouring point of the molten metal 8 can be derived from the conditions of the superheat ΔT. Thus, control of the temperature of the surface of the molten metal 8 in the cold hearth 3 and the temperature of the surface of the molten metal 12 in the mold 2 allows proper control of heating of the molten metal 8 in the cold hearth 3. This can provide operations that can produce a slab 11 with good cast surface quality over the entire longer side. The temperature of the surface of the molten metal is controlled by measuring the temperature using a device such as a thermo-viewer through a monitoring window provided in the chamber.

(Simulation of Flow Solidification)

Figure 7:
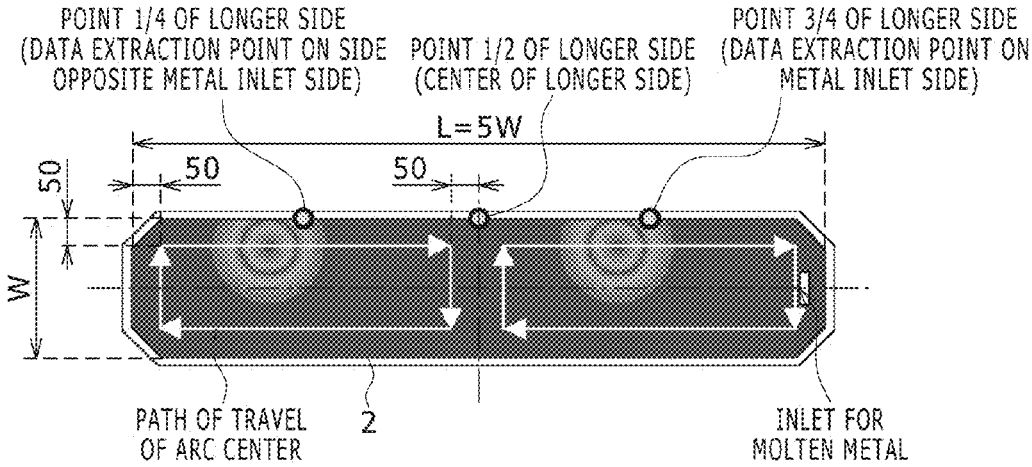
FIG. 7 is a model diagram of the mold viewed from above.

The continuous casting machine 1 according to the embodiment was used to simulate flow solidification in plasma arc melting. In the simulation, the shape of a continuously cast slab 11 having a ratio of a longer side L of the slab 11 (a longer side of the inner wall of the mold 2) to a shorter side W of the slab 11 (a shorter side of the inner wall of the mold 2) L/W of 5 was used, as illustrated in FIG. 7, which is a model diagram of the mold 2 viewed from above.

And a plasma torch 7 for heating the surface of the molten metal on the metal inlet side (the right half in the figures) and a plasma torch 7 for heating the surface on the side opposite the metal inlet side (the left half in the figures) were both driven horizontally clockwise while maintaining a fixed distance between the two plasma torches 7. Each of the plasma torches 7 was driven so that the center of the plasma arc was about 50 mm inside from the inner wall of the mold 2.

The plasma torches 7 both had a same output, a same moving speed, and a same path so that the plasma torches 7 applied the same amount of heat input to the metal inlet side and the side opposite the metal inlet side. As a result, only the molten metal 8 poured from the cold hearth 3 into the surface of the molten metal 12 in the mold 2 affected on the temperature, thereby simulating the heat input difference between the metal inlet side and the side opposite the metal inlet side.

The data was collected from a point set near the center of a longer side of the mold 2 (the ½ point of the longer side), a point set about ¼ of the length of the longer side apart from the left end of the longer side (the ¼ point of the longer side), and a point set about ¾ of the length of the longer side apart from the left end of the longer side (the ¾ point of the longer side), respectively. From the ¼ point of the longer side, data on the side opposite the metal inlet side was collected. From the ¾ point of the longer side, the data on the metal inlet side was collected. From the ½ point of the longer side, the data at the center of the longer side of the mold 2 was collected.

Then, the surface temperature of the slab 11 (the surface temperature of the ingot) Ts [° C.] and the thickness [mm] of the solidified shell at each of the data collection points were evaluated at various superheats ΔT.

Figure 8:
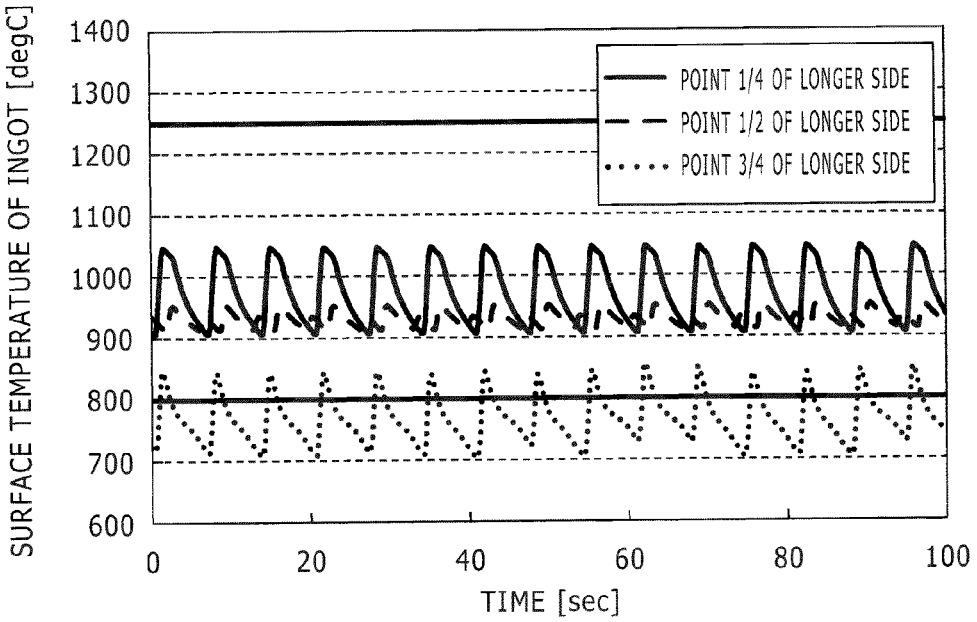
FIG. 8 is a graph illustrating the change over time in surface temperature of the ingot.
Figure 9:
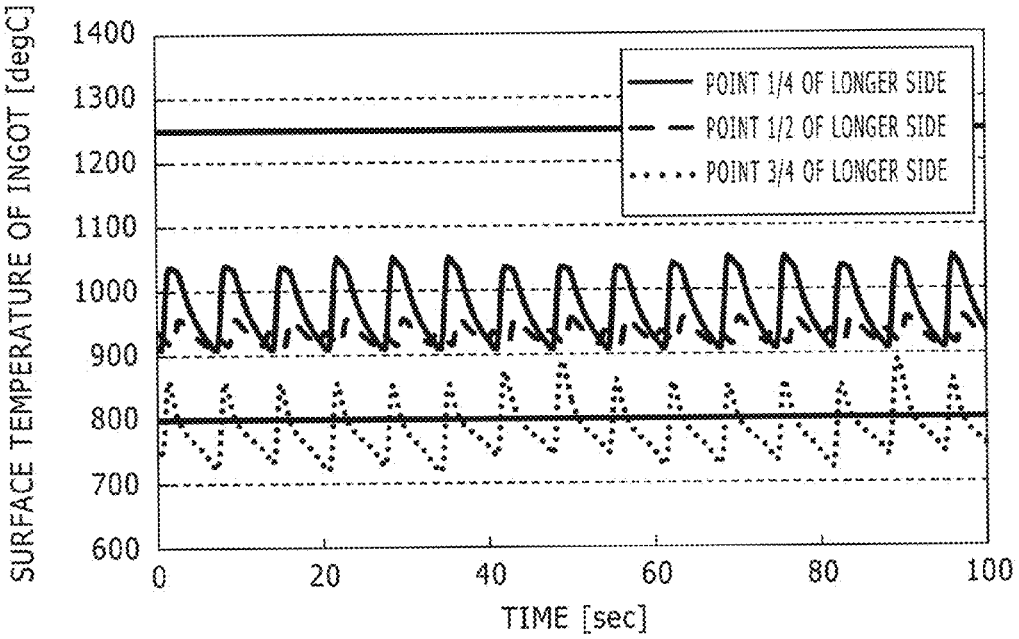
FIG. 9 is a graph illustrating the change over time in surface temperature of the ingot.
Figure 10:
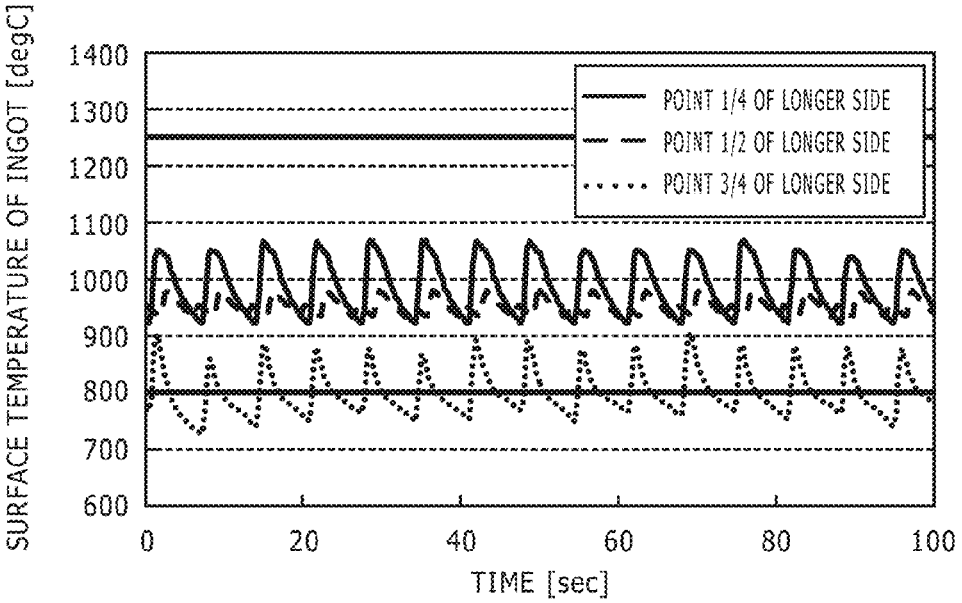
FIG. 10 is a graph illustrating the change over time in surface temperature of the ingot.

FIG. 8 illustrates the change over time in the surface temperature of the ingot at a superheat ΔT of 0° C. FIG. 9 illustrates the change over time in the surface temperature of the ingot at a superheat ΔT of 100° C. FIG. 10 illustrates the change over time in the surface temperature of the ingot at a superheat ΔT of 200° C. At all of the superheats ΔT of 0° C., 100° C., and 200° C., the ¾ point of the longer side (a data collection point on the metal inlet side) has been found to have an average surface temperature of the ingot that is outside of the range of 800° C.<Ts<1250° C.

Figure 11:
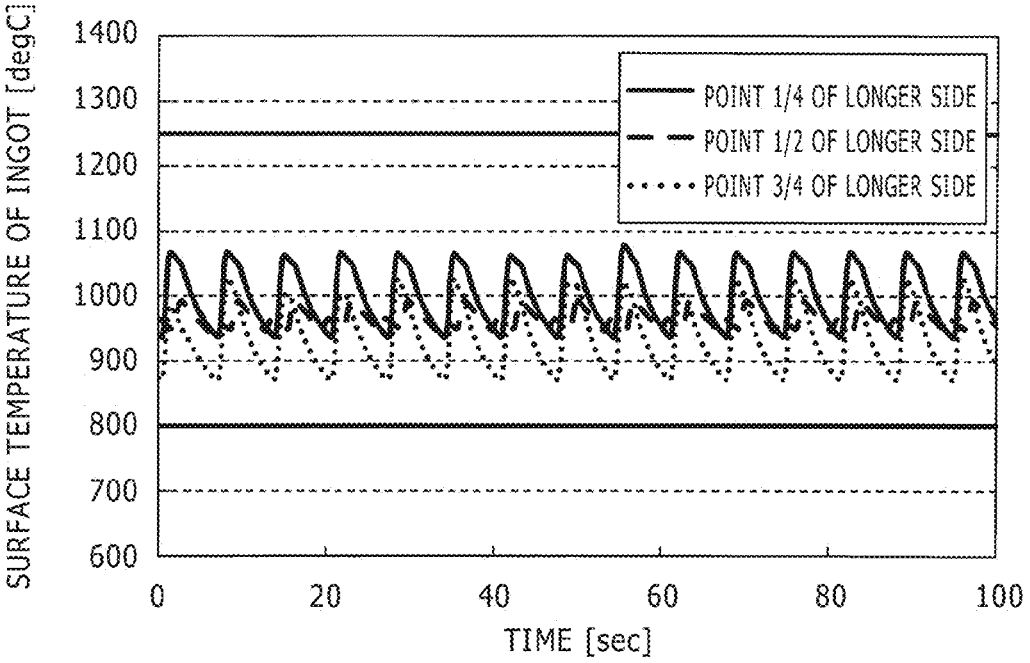
FIG. 11 is a graph illustrating the change over time in surface temperature of the ingot.
Figure 12:
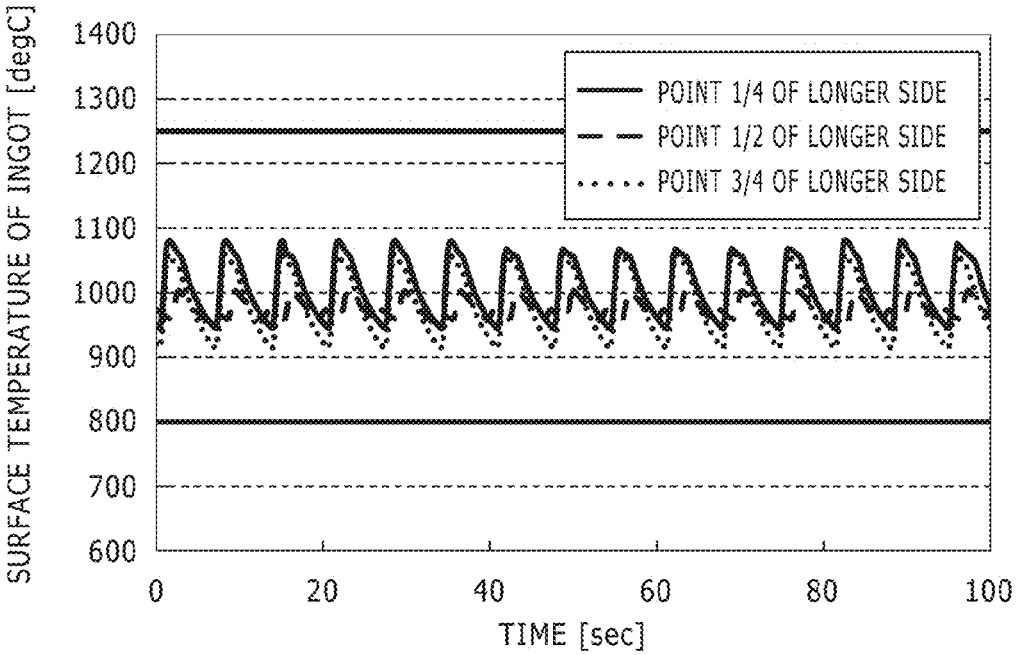
FIG. 12 is a graph illustrating the change over time in surface temperature of the ingot.

FIG. 11 illustrates the change over time in the surface temperature of the ingot at a superheat ΔT of 300° C. FIG. 12 illustrates the change over time in the surface temperature of the ingot at a superheat ΔT of 400° C. At either of the superheats ΔT of 300° C. and 400° C., the ¾ point of the longer side (a data collection point on the metal inlet side) has found to have an average surface temperature of the ingot that is within the range of 800° C.<Ts<1250° C.

Figure 13:
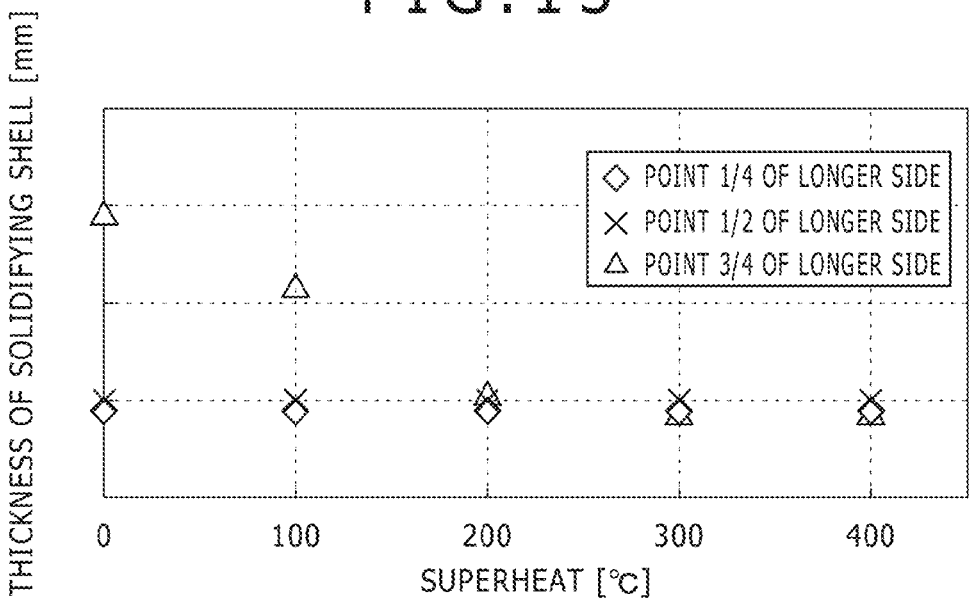
FIG. 13 is a graph illustrating the relationship between superheat and the thickness of a solidified shell.

FIG. 13 illustrates the relationship between the superheat ΔT and the thickness of the solidified shell 13. The solidified shell 13 had the substantially constant thickness regardless of the superheat ΔT at the ¼ point of the longer side (a data collection point on the side opposite the metal inlet side) and at the ½ point of the longer side (a data collection point at the center of the longer side of the mold 2 ). In contrast, the thickness of the solidified shell 13 at the ¾ point of the longer side (a data collection point on the metal inlet side) at superheats ΔT of 0° C., 100° C., and 200° C. was larger than the thickness of the solidified shell 13 at the ¼ point of the longer side and the ½ point of the longer side, which indicates difference in solidification between the metal inlet side and the side opposite the metal inlet side. At superheats ΔT of 300° C. and 400° C., the thickness of the solidified shell 13 at the ¾ point of the longer side (the data collection point on the metal inlet side) was equal to the thickness of the solidified shell 13 at the ¼ point of the longer side and the ½ point of the longer side, which indicates that difference in solidification between the metal inlet side and the side opposite the metal inlet side was reduced.

Figure 14:
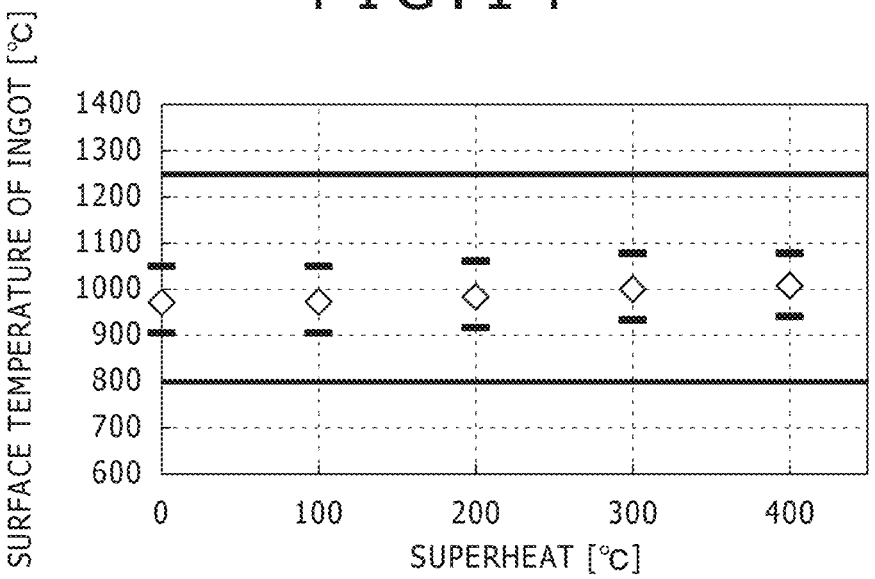
FIG. 14 is a graph illustrating the relationship between superheat and surface temperature of the ingot.

Table 1 illustrates average, maximum, and minimum surface temperatures of the ingot at the ¼ point of the longer side (the data collection point on the side opposite the metal inlet side) at various superheats ΔT. FIG. 14 illustrates the relationship between the superheat ΔT and the surface temperature of the ingot at the ¼ point of the longer side.

TABLE 1

| | Surface Temperature of Ingot [° C.] | | | |
|---|---|---|---|---|
| Superheat [° C.] | Average | Maximum | Minimum | Cast surface Quality |
| 0 | 973.8 | 1047.7 | 906.6 | ○ |
| 100 | 973.7 | 1057.9 | 908.7 | ○ |
| 200 | 988.3 | 1070.2 | 922.9 | ○ |
| 300 | 1000.2 | 1078.5 | 936.0 | ○ |
| 400 | 1009.4 | 1081.7 | 944.6 | ○ |

FIG. 14 reveals that the surface temperature of the ingot at the ¼ point of the longer side was within the range of 800° C.<Ts<1250° C., regardless of the superheat ΔT. This indicates that the temperature of the molten metal 8 poured into the surface of the molten metal 12 in the mold 2 had a little effect on the side opposite the metal inlet side.

Figure 15:
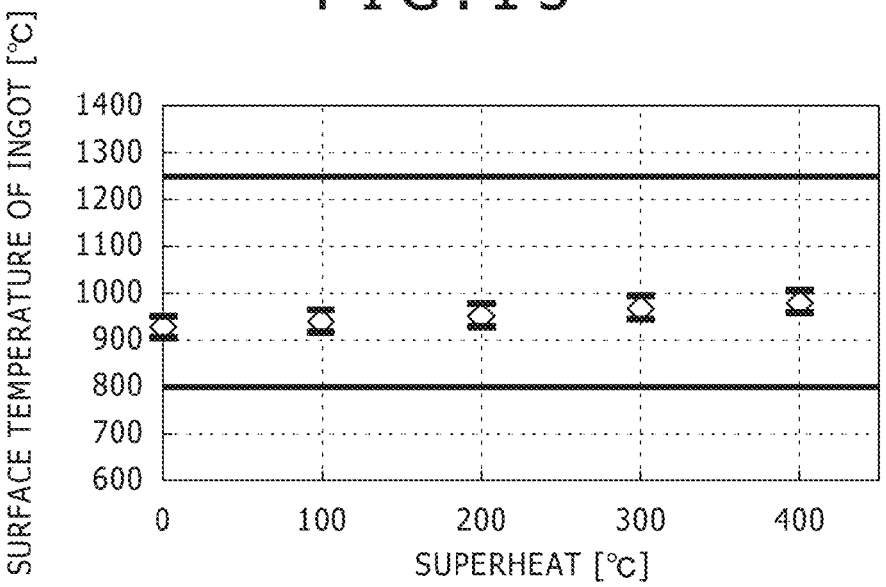
FIG. 15 is a graph illustrating the relationship between superheat and surface temperature of the ingot.

Table 2 illustrates average, maximum, and minimum surface temperatures of the ingot at the ½ point of the longer side (the data collection point at the center of the longer side of the mold 2) at various superheats ΔT. FIG. 15 illustrates the relationship between the superheat ΔT and the surface temperature of the ingot at the ½ point of the longer side.

TABLE 2

| Superheat [° C.] | Surface Temperature of Ingot [° C.] Average | Maximum | Minimum | Cast surface Quality |
|---|---|---|---|---|
| 0 | 928.8 | 952.4 | 912.6 | ○ |
| 100 | 931.9 | 956.7 | 915.7 | ○ |
| 200 | 951.6 | 979.0 | 933.5 | ○ |
| 300 | 965.0 | 993.3 | 946.0 | ○ |
| 400 | 974.2 | 1003.1 | 955.1 | ○ |

FIG. 15 reveals that the surface temperature of the ingot at the ½ point of the longer side was within the range of 800° C.<Ts<1250° C., regardless of the superheat ΔT. This indicates that the temperature of the molten metal 8 poured into the surface of the molten metal 12 in the mold 2 had a little effect on the region around the center of the longer side of the mold 2.

Figure 16:
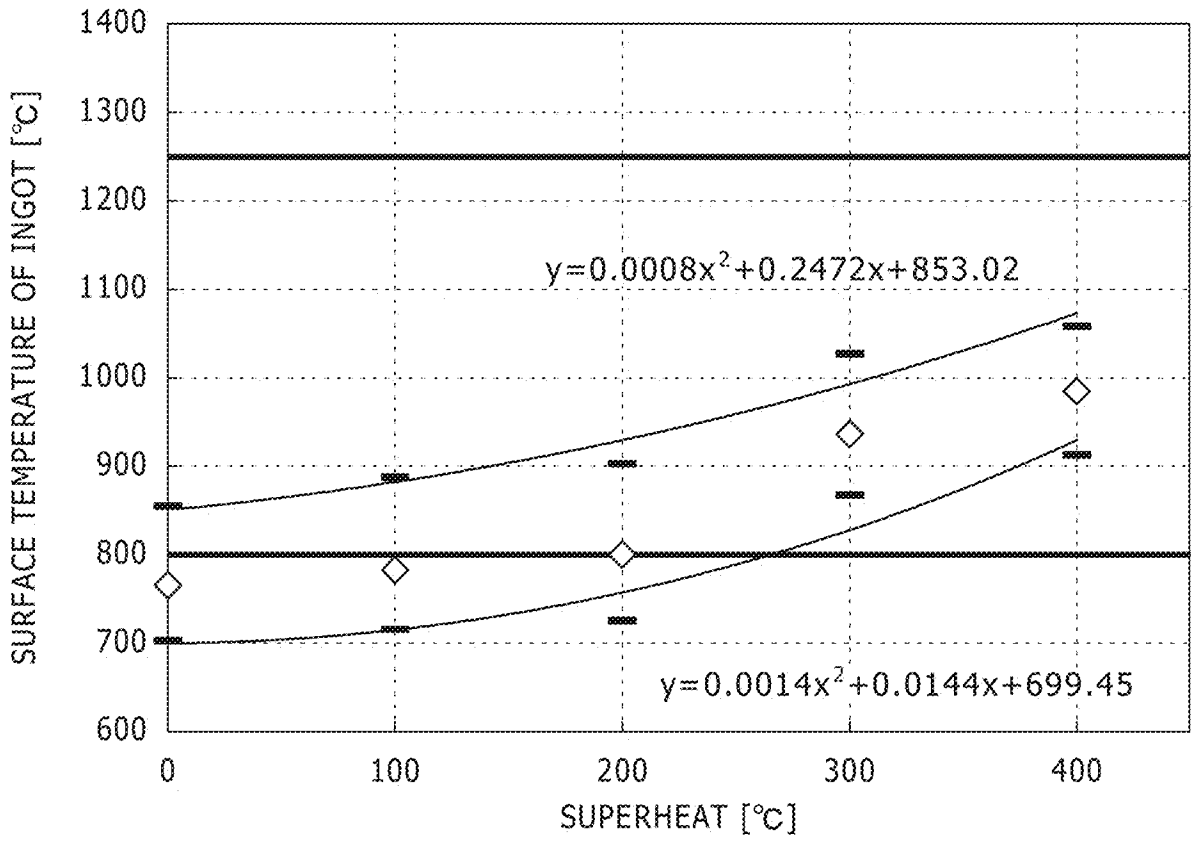
FIG. 16 is a graph illustrating the relationship between superheat and surface temperature of the ingot.

Table 3 illustrates average, maximum, and minimum surface temperatures of the ingot at the ¾ point of the longer side (the data collection point on the metal inlet side) at various superheats ΔT. FIG. 16 illustrates the relationship between the superheat ΔT and the surface temperature of the ingot at the ¾ point of the longer side.

TABLE 3

| Superheat [° C.] | Surface Temperature of Ingot [° C.] Average | Maximum | Minimum | Cast surface Quality |
|---|---|---|---|---|
| 0 | 766.1 | 855.6 | 703.5 | X |
| 100 | 782.7 | 889.7 | 717.3 | X |
| 200 | 798.9 | 904.0 | 726.7 | X |
| 300 | 937.0 | 1029.4 | 869.6 | ○ |
| 400 | 984.5 | 1061.0 | 914.5 | ○ |

FIG. 16 reveals that the surface temperature of the ingot at the ¾ point of the longer side was within the range of 800° C.<Ts<1250° C. when the superheat ΔT satisfies the following Formula (1) and Formula (2).

$$0.0014\Delta T^2+0.0144\Delta T+699.45>800 \quad \text{Formula (1)}$$

$$0.0008\Delta T^2+0.2472\Delta T+853.02<1250 \quad \text{Formula (2)}$$

Formula (1) and Formula (2) were both derived through approximation on the basis of a quadratic function by using the maximum and minimum values at various superheats ΔT. The respective coefficients of the approximation formulae were calculated using the least squares method.

FIG. 16 reveals that the surface temperature of the ingot at the ¾ point of the longer side was suitably within the range of 800° C.<Ts<1250° C. at a superheat ΔT of 300° C. or higher.

(Effects)

As described above, a method for continuously casting a slab containing titanium or a titanium alloy according to the embodiment includes pouring the molten metal 8 into the mold 2 from one of the paired shorter sides of the mold 2 while allowing superheat ΔT [° C.], which is a temperature difference obtained by subtracting the melting point Tm [° C.] of the raw material from the temperature Tin [° C.] of the molten material on the surface of the molten metal in the mold and at the pouring point of the molten metal, to satisfy the following Formula (1) and Formula (2). To resolve insufficient heat input of the surface of the molten metal on the metal inlet side, the surface of the molten metal 12 in the mold 2 at the pouring point of the molten metal 8 needs to have a temperature that is at least equal to or higher than the average temperature of the surface of the molten metal on the side opposite the metal inlet side. Satisfaction of the above Formula (1) and Formula (2) by the superheat ΔT allows an increase of the temperature of the surface of the molten metal 12 in the mold 2 at the pouring point of the molten metal 8. This reduces the difference in the temperature/the amount of heat input between the metal inlet side and the side opposite the metal inlet side, and thus the slab 11 can have good cast surface quality over the entire longer side. In other words, the slab 11 with a good cast surface can be cast.

The superheat ΔT of 300° C. or higher suitably allows an increase of the temperature of the surface of the molten metal 12 in the mold 2 at the pouring point of the molten metal 8. This can sufficiently reduce the difference in the temperature/the amount of heat input between the metal inlet side and the side opposite the metal inlet side.

The surface of the molten metal 12 in the mold 2 is heated by plasma arc to increase the temperature of the surface of the molten metal 12 in the mold 2 at the pouring point of the molten metal 8, which can provide a slab 11 having good cast surface quality over the entire longer side.

(Modification of Embodiment)

Although an embodiment of the present invention has been described, the embodiment is merely for illustrative purposes and not for limitation of the present invention. The specific configurations can be appropriately modified. The functions and the effects described in "Description of the Embodiments" are merely the most suitable functions and effects of the present invention, and the functions and effects of the present invention are not limited to those described in the embodiment of the present invention.

Although in the above embodiment, for example, satisfaction of Formula (1) and Formula (2) by the superheat ΔT allows an increase of the temperature of the surface of the molten metal 12 in the mold 2 at the pouring point of the molten metal 8, the present invention is not limited to such configuration. As described above, the pouring lip 3*a* of the cold hearth 3 has a narrow width and high cooling ability. Thus, when the molten metal 8 is passed through the pouring lip 3*a*, the temperature of the metal 8 is decreased to around the melting point. Then, the temperature of the surface of the molten metal 12 in the mold 2 at the pouring point of the molten metal 8 may be increased by reducing the cooling ability of the pouring lip 3*a* of the cold hearth 3. The cooling ability of the pouring lip 3*a* can be reduced by incorporating, into the pouring lip 3*a*, metal such as titanium (Ti), tungsten (W), tantalum (Ta), and molybdenum (Mo) having a thermal conductivity that is lower than the conductivity of the material of the pouring lip 3*a*, which is copper, or by providing a layer of air having a thermal conductivity lower than the conductivity of copper to the interior of the pouring lip 3*a*.

Although in the above embodiment, heating of the surface of the molten metal 12 in the mold 2 by plasma arc has been described, the present invention is not limited to such configuration, and the surface of the molten metal 12 in the mold 2 may be heated by electron beam. Similarly, the present invention is not limited to the configuration in which the molten metal 8 in the cold hearth 3 is heated by plasma arc, and the metal 8 may be heated by electron beam.

What is claimed is:

1. A method for continuously casting a slab containing titanium or a titanium alloy, the method comprising melting a raw material containing titanium or a titanium alloy to form molten metal, and pouring the molten metal into an open mold having a rectangular cross-section where the molten metal is solidified and withdrawn from the bottom of the mold, wherein the molten metal is poured from one of the paired shorter sides of the mold while allowing superheat ΔT [° C.], which is a temperature difference obtained by subtracting the melting point Tm [° C.] of the raw material from the temperature Tin [° C.] of the molten material on the surface of the molten metal in the mold and at the pouring point of the molten metal, to satisfy the following Formula (1) and Formula (2):

$$0.0014\Delta T^2+0.0144\Delta T+699.45>800 \quad \text{Formula (1)}$$

$$0.0008\Delta T^2+0.2472\Delta T+853.02<1250. \quad \text{Formula (2)}$$

2. The method for continuously casting a slab containing titanium or a titanium alloy according to claim 1, wherein the superheat ΔT is 300° C. or higher.

3. The method for continuously casting a slab containing titanium or a titanium alloy according to claim 2, wherein the surface of the molten metal in the mold is heated by plasma arc.

4. The method for continuously casting a slab containing titanium or a titanium alloy according to claim 1, wherein the surface of the molten metal in the mold is heated by plasma arc.

* * * * *